US007308944B2

(12) United States Patent
Johnston et al.

(10) Patent No.: US 7,308,944 B2
(45) Date of Patent: Dec. 18, 2007

(54) EXPANDER TOOL FOR USE IN A WELLBORE

(75) Inventors: Gary Johnston, Balmedie (GB); Wayne Rudd, Ponteland (GB); David Hillis, Balmedie (GB); Gary Pendleton, Stanley (GB); Kevin Scott, Blyth (GB)

(73) Assignee: Weatherford/Lamb, Inc., Houston, TX (US)

( * ) Notice: Subject to any disclaimer, the term of this patent is extended or adjusted under 35 U.S.C. 154(b) by 81 days.

(21) Appl. No.: 10/680,724

(22) Filed: Oct. 7, 2003

(65) Prior Publication Data

US 2005/0072569 A1 Apr. 7, 2005

(51) Int. Cl.
*E21B 23/04* (2006.01)

(52) U.S. Cl. ..... 166/380; 166/212; 72/120

(58) Field of Classification Search ..... 166/384, 166/207, 210, 380, 212, 277; 72/113, 119, 72/120

See application file for complete search history.

(56) References Cited

U.S. PATENT DOCUMENTS

| | | | | |
|---|---|---|---|---|
| 761,518 | A | 5/1904 | Lykken | |
| 988,054 | A | 3/1911 | Wiet | |
| 1,301,285 | A | 4/1919 | Leonard | |
| 1,324,303 | A | 12/1919 | Carmichael | |
| 1,412,278 | A * | 4/1922 | Dixon | 72/119 |
| 1,545,039 | A | 7/1925 | Deavers | |
| 1,561,418 | A | 11/1925 | Duda | |
| 1,569,729 | A * | 1/1926 | Duda | 72/45 |
| 1,597,212 | A | 8/1926 | Spengler | |
| 1,880,218 | A | 10/1932 | Simmons | |
| 1,930,825 | A | 10/1933 | Raymond | |
| 1,981,525 | A | 11/1934 | Price | |
| 2,017,451 | A | 10/1935 | Wickersham | |

(Continued)

FOREIGN PATENT DOCUMENTS

| | | |
|---|---|---|
| DE | 3213464 | 10/1983 |

(Continued)

OTHER PUBLICATIONS

Expandable Slotted Tubes Offer Well Design Benefits, Hart's Petroleum Engineer International, pp. 60-63, Oct. 1996, U.S.A.

(Continued)

*Primary Examiner*—Daivd Bagnell
*Assistant Examiner*—Daniel P Stephenson
(74) *Attorney, Agent, or Firm*—Patterson & Sheridan, LLP

(57) ABSTRACT

The present invention generally relates to apparatus and methods for expanding a tubular. In one embodiment, an expander tool includes a body having at least one recess therein. An expansion assembly disposable in the at least one recess includes a piston that outwardly extends from the body in response to a radially outward force. The expansion assembly includes one or more rollers disposed on a shaft such that the rollers rotate at different speeds. In order to improve a rolling ratio, the shaft is arranged on the piston at an outward angle relative to a longitudinal axis of the tool. The expansion assembly is disposed along the tool at a skew to provide tractoring and reduce slippage due to axial movement. A bearing adjacent the roller and rotationally secured to the roller reduces roller heating and wear. In another aspect, methods for expanding a tubular within a wellbore are provided.

21 Claims, 8 Drawing Sheets

U.S. PATENT DOCUMENTS 2,214,226 A 9/1940 English
2,216,226 A 10/1940 Bumpous
2,298,703 A * 10/1942 Key et al. ..... 72/119
2,383,214 A 8/1945 Prout et al.
2,424,878 A 7/1947 Crook
2,499,630 A 3/1950 Clark
2,519,116 A 8/1950 Crake
2,627,891 A 2/1953 Clark
2,633,374 A 3/1953 Boice
2,663,073 A 12/1953 Bieber et al.
2,754,577 A 7/1956 Maxwell
2,898,971 A 8/1959 Hempel
3,028,915 A 4/1962 Jennings
3,039,530 A 6/1962 Condra
3,087,546 A 4/1963 Wooley
3,167,122 A 1/1965 Lang
3,179,168 A 4/1965 Vincent
3,186,485 A 6/1965 Owen
3,191,677 A 6/1965 Kinley
3,191,680 A 6/1965 Vincent
3,195,646 A 7/1965 Brown
3,203,451 A 8/1965 Vincent
3,203,483 A 8/1965 Vincent
3,245,471 A 4/1966 Howard
3,297,092 A 1/1967 Jennings
3,326,293 A 6/1967 Skipper
3,353,599 A 11/1967 Swift
3,354,955 A 11/1967 Berry
3,467,180 A 9/1969 Pensotti
3,477,506 A 11/1969 Malone
3,489,220 A 1/1970 Kinley
3,575,026 A * 4/1971 Troyanski ..... 72/113
3,583,200 A 6/1971 Cvijanovic et al.
3,669,190 A 6/1972 Sizer et al.
3,689,113 A 9/1972 Blaschke
3,691,624 A 9/1972 Kinley
3,712,376 A 1/1973 Owen et al.
3,746,091 A 7/1973 Owen et al.
3,776,307 A 12/1973 Young
3,780,562 A 12/1973 Kinley
3,785,193 A 1/1974 Kinley et al.
3,818,734 A 6/1974 Bateman
3,820,370 A 6/1974 Duffy
3,911,707 A 10/1975 Minakov et al.
3,948,321 A 4/1976 Owen et al.
3,977,076 A 8/1976 Vieira et al.
4,069,573 A 1/1978 Rogers, Jr. et al.
4,127,168 A 11/1978 Hanson et al.
4,159,564 A 7/1979 Cooper
4,288,082 A 9/1981 Setterberg
4,319,393 A 3/1982 Pogonowski
4,324,407 A 4/1982 Upham et al.
4,349,050 A 9/1982 Bergstrom et al.
4,359,889 A 11/1982 Kelly
4,362,324 A 12/1982 Kelly
4,371,199 A 2/1983 Kushner et al.
4,382,379 A 5/1983 Kelly
4,387,502 A 6/1983 Dom
4,407,150 A 10/1983 Kelly
4,414,739 A 11/1983 Kelly
4,429,620 A 2/1984 Burkhardt et al.
4,445,201 A 4/1984 Pricer
4,450,612 A 5/1984 Kelly
4,470,280 A 9/1984 Kelly
4,483,399 A 11/1984 Colgate
4,487,630 A 12/1984 Crook et al.
4,502,308 A 3/1985 Kelly
4,505,142 A 3/1985 Kelly
4,505,612 A 3/1985 Shelley, Jr.
4,531,581 A 7/1985 Pringle et al.
4,567,631 A 2/1986 Kelly
4,581,617 A 4/1986 Yoshimoto et al.
4,588,030 A 5/1986 Blizzard
4,626,129 A 12/1986 Kothmann et al.
4,697,640 A 10/1987 Szarka
4,807,704 A 2/1989 Hsu et al.
4,848,469 A 7/1989 Baugh et al.
4,866,966 A 9/1989 Hagen
4,883,121 A 11/1989 Zwart
4,976,322 A 12/1990 Abdrakhmanov et al.
4,997,320 A 3/1991 Hwang
5,014,779 A 5/1991 Meling et al.
5,052,483 A 10/1991 Hudson
5,052,849 A 10/1991 Zwart
5,076,730 A * 12/1991 Bergey ..... 405/184.3
5,156,209 A 10/1992 McHardy
5,267,613 A 12/1993 Zwart et al.
5,271,472 A 12/1993 Leturno
5,301,760 A 4/1994 Graham
5,307,879 A 5/1994 Kent
5,322,127 A 6/1994 McNair et al.
5,348,095 A 9/1994 Worrall et al.
5,366,012 A 11/1994 Lohbeck
5,409,059 A 4/1995 McHardy
5,435,400 A 7/1995 Smith
5,472,057 A 12/1995 Winfree
5,520,255 A 5/1996 Barr et al.
5,553,679 A 9/1996 Thorp
5,560,426 A 10/1996 Trahan et al.
5,636,661 A 6/1997 Moyes
5,667,011 A 9/1997 Gill et al.
5,685,369 A 11/1997 Ellis et al.
5,706,905 A 1/1998 Barr
5,785,120 A 7/1998 Smalley et al.
5,887,668 A 3/1999 Haugen et al.
5,901,787 A 5/1999 Boyle
5,901,789 A 5/1999 Donnelly et al.
5,924,745 A 7/1999 Campbell
5,960,895 A 10/1999 Chevallier et al.
5,979,571 A 11/1999 Scott et al.
6,021,850 A 2/2000 Wood et al.
6,029,748 A 2/2000 Forsyth et al.
6,070,671 A 6/2000 Cumming et al.
6,098,717 A 8/2000 Bailey et al.
6,325,148 B1 12/2001 Trahan et al.
6,425,444 B1 7/2002 Metcalfe et al.
6,446,323 B1 9/2002 Metcalfe et al.
6,454,013 B1 9/2002 Metcalfe
6,457,532 B1 10/2002 Simpson
6,527,049 B2 3/2003 Metcalfe et al.
6,543,552 B1 4/2003 Metcalfe et al.
6,571,672 B1 6/2003 Rudd
6,578,630 B2 * 6/2003 Simpson et al. ..... 166/55.8
6,808,455 B1 * 10/2004 Solorenko et al. ..... 464/20
2001/0033704 A1 * 10/2001 Jackson ..... 384/420
2001/0040054 A1 11/2001 Haugen et al.
2002/0145281 A1 10/2002 Metcalfe et al.
2002/0166664 A1 11/2002 Lauritzen et al.
2002/0166668 A1 11/2002 Metcalfe
2003/0106698 A1 * 6/2003 Simpson et al. ..... 166/382
2003/0156769 A1 * 8/2003 Whang ..... 384/291
2004/0045720 A1 3/2004 Duggan
2004/0118571 A1 6/2004 Lauritzen et al.

FOREIGN PATENT DOCUMENTS

DE 41 33 802 10/1992
EP 0 952 305 10/1999
EP 0 961 007 12/1999
GB 730338 5/1955
GB 792886 4/1958
GB 997721 7/1965
GB 1 277 461 6/1972
GB 1 448 304 9/1976

| | | |
|---|---|---|
| GB | 1 457 843 | 12/1976 |
| GB | 1 582 392 | 1/1981 |
| GB | 2 216 926 | 10/1989 |
| GB | 2 313 860 | 12/1997 |
| GB | 2 320 734 | 7/1998 |
| GB | 2 329 918 | 4/1999 |
| WO | WO 92/01139 | 1/1992 |
| WO | WO 93/24728 | 12/1993 |
| WO | WO 93/25800 | 12/1993 |
| WO | WO 94/25655 | 11/1994 |
| WO | WO 97/21901 | 6/1997 |
| WO | WO 98/00626 | 1/1998 |
| WO | WO 99/02818 | 1/1999 |
| WO | WO 99/18328 | 4/1999 |
| WO | WO 99/23354 | 5/1999 |
| WO | WO 00/37772 | 6/2000 |

OTHER PUBLICATIONS

U.K. Search Report, Application No. GB0422280.8, dated Dec. 21, 2004.

* cited by examiner

FIG. 1
( PRIOR ART )
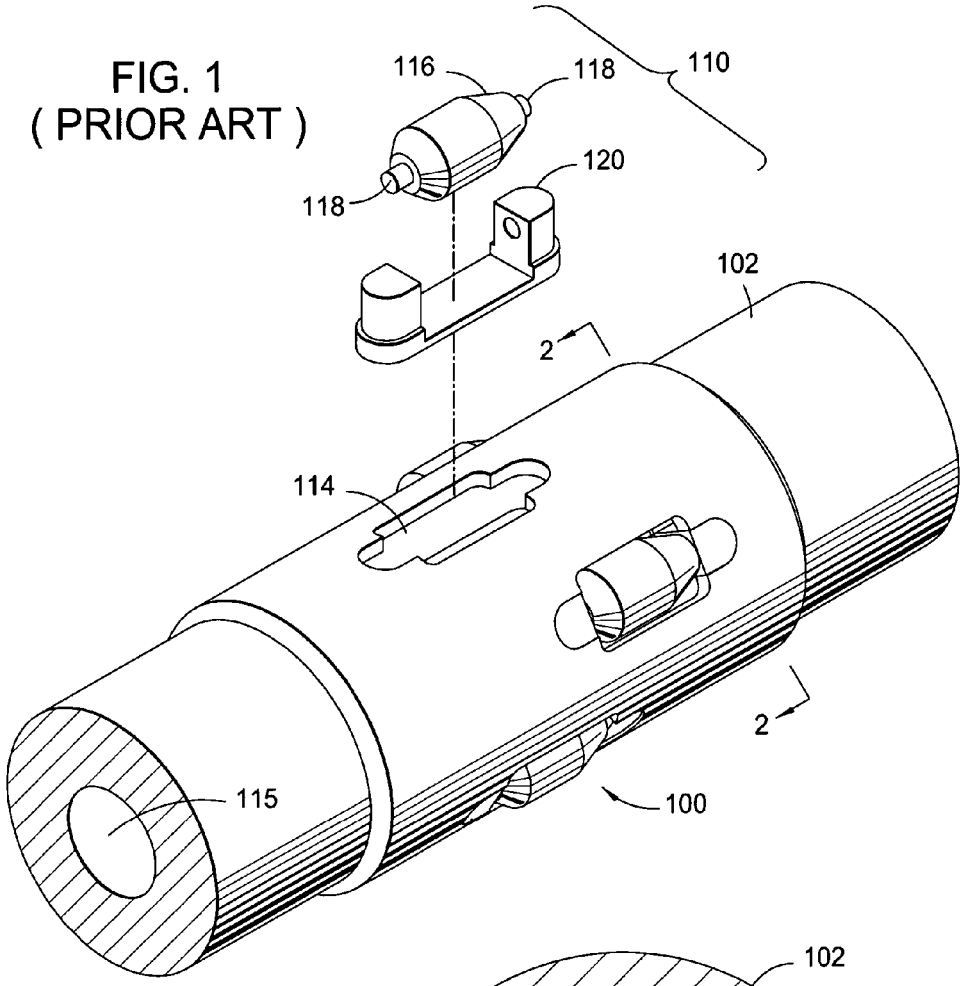
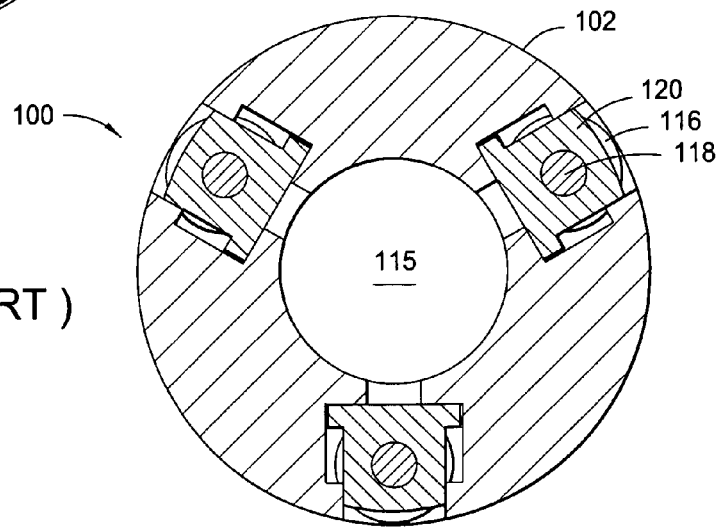
FIG. 2
( PRIOR ART )

EXPANDER TOOL FOR USE IN A WELLBORE

BACKGROUND OF THE INVENTION

1. Field of the Invention

The present invention generally relates to wellbore completion. More particularly, the invention relates to an apparatus and method for expanding a tubular body. More particularly still, the invention relates to an expander tool for expanding a section of tubulars within a wellbore.

2. Description of the Related Art

Hydrocarbon and other wells are completed by forming a borehole in the earth and then lining the borehole with steel pipe or casing to form a wellbore. After a section of wellbore is formed by drilling, a string of casing is lowered into the wellbore and temporarily hung therein from the surface of the well. Using methods known in the art, the casing is cemented into the wellbore by circulating cement into an annular area defined between the outer wall of the casing and the borehole. The combination of cement and casing strengthens the wellbore and facilitates the isolation of certain areas of a formation surrounding the casing for the production of hydrocarbons.

It is common to employ more than one string of casing in a wellbore. In this respect, a first string of casing is set in the wellbore when the well is drilled to a first designated depth. The first string of casing is hung from the surface, and then cement is circulated into the annulus behind the casing. The well is then drilled to a second designated depth and a second string of smaller diameter casing or liner is run into the well. The second string is set at a depth such that the upper portion of the second string of casing overlaps the lower portion of the first string of casing. The second casing string is then fixed or "hung" off of the existing casing by the use of slips which utilize slip members and cones to wedgingly fix the new string of liner in the wellbore. The second casing string is then cemented. This process is typically repeated with additional casing strings until the well has been drilled to total depth. In this manner, wells are typically formed with two or more strings of casing of an ever decreasing diameter.

Apparatus and methods are emerging that permit tubular bodies to be expanded within a wellbore. Using this technology, a tubular string can be hung off a prior string by expanding its diameter in an area of overlap with the prior string. Further, an entire string of casing could be expanded to create a "monobore" diameter of casing in a well. The apparatus typically includes an expander tool that is run into the wellbore on a working string. The expander tool includes radially expandable members, or "expansion assemblies," which are urged radially outward from a body of the expander tool, either in response to mechanical forces, or in response to fluid pressure in the working string. The expansion assemblies are expanded into contact with a surrounding tubular body. Outward force applied by the expansion assemblies cause the surrounding tubular to be expanded. Rotation of the expander tool, in turn, creates a circumferential expansion of the tubular. An exemplary rotary expander tool is described in U.S. Pat. No. 6,457,532 issued to Simpson on Oct. 1, 2002, which is herein incorporated by reference in its entirety.

Another example of an exemplary expansion tool is illustrated in FIGS. 1 and 2. More specifically, FIG. 1 is an exploded view of an exemplary expander tool 100. FIG. 2 presents the same expander tool 100 in cross-section, with the view taken across line 2-2 of FIG. 1.

The expander tool 100 has a body 102 which is hollow and generally tubular. The central body 102 has a plurality of recesses 114 to hold a respective expansion assembly 110.

Each of the recesses 114 has substantially parallel sides and holds a respective piston 120. The pistons 120 are radially slidable, one piston 120 being slidably sealed within each recess 114. The back side of each piston 120 is exposed to the pressure of fluid within a hollow bore 115 of the expander tool 100. In this manner, pressurized fluid provided from the surface of the well can act upon the pistons 120 and cause them to extend outwardly.

Disposed above each piston 120 is a roller 116. The rollers 116 are near cylindrical and slightly barrel shaped. Each of the rollers 116 is supported by a shaft 118 at each end of the respective roller 116 for rotation about a respective axis. The rollers 116 are generally parallel to the longitudinal axis of the tool 100. In the arrangement of FIG. 1, the plurality of rollers 116 is radially offset at mutual 120-degree circumferential separations around the central body 102. In the arrangement shown in FIG. 1, two offset rows of rollers 116 are shown. However, only one row or more than two rows of roller 116, may be incorporated into the body 102.

As sufficient pressure is generated on the bottom piston surface behind the expansion assembly 110, the tubular being acted upon (not shown) by the expander tool 100 is expanded past a point of elastic deformation. In this manner, the diameter of the tubular is increased within the wellbore. By rotating the expander tool 100 in the wellbore and/or moving the expander tool 100 axially in the wellbore with the expansion assemblies 110 actuated, a tubular can be expanded into plastic deformation along a predetermined length.

Even though the known expander tools, such as the tool 100 shown in FIGS. 1-2, may be used to expand a surrounding tubular, they are not always reliable. For example, the rollers 116 in the known expander tools may overheat at their back face as the expander tool is urged axially through a tubular due to friction between the rotating rollers 116 and the stationary thrust bearing which leads to premature wear and subsequently to premature failure of the expander tool. In another example, an outer surface of the rollers 116 in the known expander tools may be subject to a differential speed at one end of the roller 116 relative to the other end of the roller 116 while expanding the surrounding tubular, which results in a residual torsional effect in the tubular and other inefficiencies, such as wear, heat, and increased torque. The differential speed is due to the varying diameter of the tubular as it is being expanded by contact with the roller 116 that also has a varying diameter. In a further example, the expansion assembly 110 in the known expander tools may misalign with the centerline of the tool 100 while expanding the surrounding tubular, which may result in a premature failure of the tool 100. As the tool 100 moves through a tubular, uneven radial force between the first and second ends of the roller cause the misalignment. In yet another example, the known expander tools, such as the tool 100 shown in FIGS. 1-2, may lack a sufficient maximum expansion ratio and may provide limited size of the thrust bearing due to dimensional constraints.

Therefore, a need exists for an improved expander tool that will address the above mentioned problems.

SUMMARY OF THE INVENTION

The present invention generally relates to an apparatus and method for expanding a tubular body. In one aspect, an expander tool for use in a wellbore is provided. The expander tool comprises a body having a bore therethrough and at least one recess formed therein. The expander tool further includes an expansion assembly disposable in the at least one recess, wherein the expansion assembly includes a piston which is outwardly extendable from the body in response to the radially outward force. The expansion assembly further includes a roller rotationally disposed on a shaft, wherein the roller and the shaft are constructed and arranged on the piston at an outward angle relative to a longitudinal axis of the expander tool. The expansion assembly may be disposed along the expander tool at a skew to provide a tractoring effect.

In another aspect, the expander tool includes an upper bearing body disposed adjacent an upper end of the roller. The upper bearing body includes a front bearing body and a rear bearing body, wherein the front bearing body is operatively attached to the roller, thereby rotating with the roller and the back bearing body is operatively attached to the piston, thereby remaining rotationally stationary.

In another aspect, the expander tool includes a first roller rotationally disposed on a shaft and a second roller rotationally disposed on the shaft adjacent the first roller, whereby the second roller rotates at a different rate than the first roller.

In another aspect, a method for expanding a tubular body within a wellbore is provided. The method includes disposing an expander tool at a lower end of a working string, the expander tool having a body and a plurality of recesses formed therein for receiving an expansion assembly. The method further includes activating the expander tool, wherein the expansion assembly extends radially outward and expanding the tubular body within the wellbore.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

FIG. 1 is an exploded view of a prior art expander tool.

FIG. 2 is a cross-sectional view of the expander tool taken across line 2-2 of FIG. 1.

DETAILED DESCRIPTION OF THE PREFERRED EMBODIMENT

Embodiments of the present invention generally provide an improved expander tool for expanding tubulars in a wellbore. For ease of explanation, the invention will be described generally in relation to a cased vertical wellbore. It is to be understood, however, that the invention may be employed in a horizontal wellbore or a diverging wellbore without departing from principles of the present invention.

Figure 3:
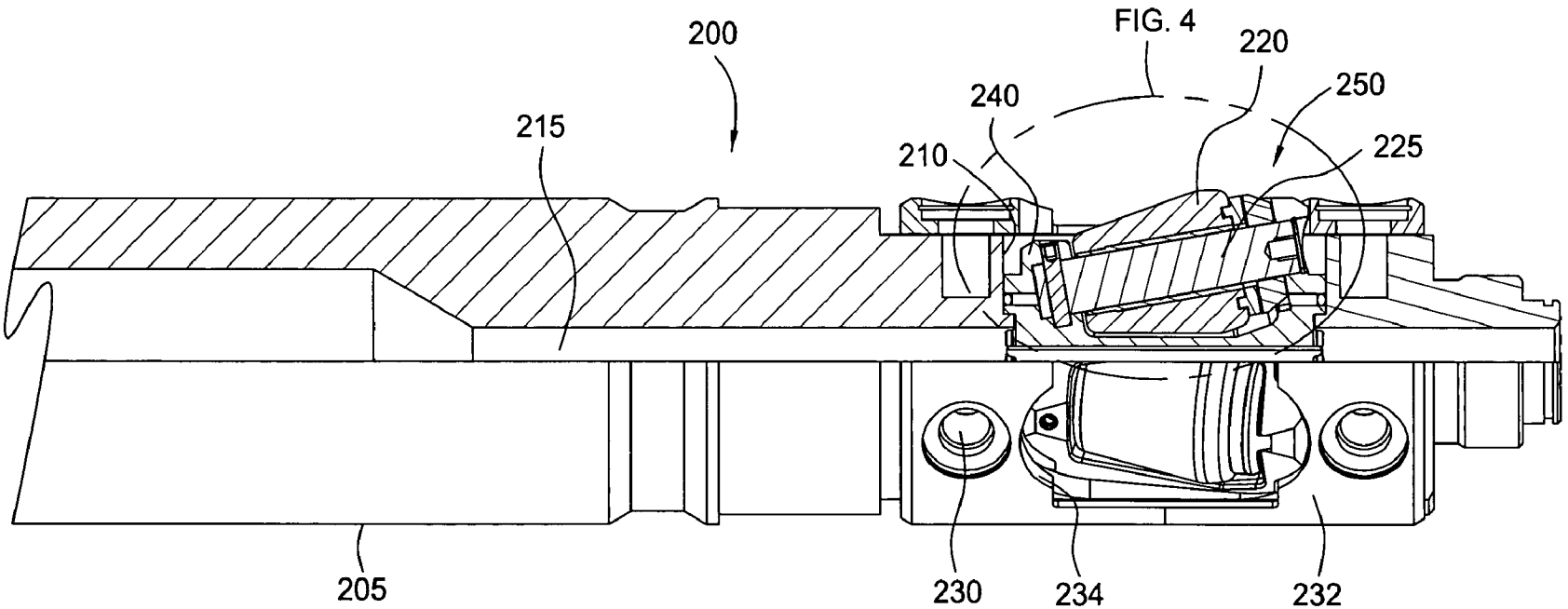
FIG. 3 is a partial section view of an expander tool of the present invention in one embodiment.

FIG. 3 illustrates a partial section view of an expander tool 200 of the present invention in an embodiment. The expander tool 200 is constructed and arranged to expand a surrounding tubular (not shown) in a wellbore (not shown) as will be further illustrated in subsequent FIGS. 9-12. The expander tool 200 includes a body 205 that generally defines a tubular having a bore 215 therethrough to provide a fluid pathway through the expander tool 200. The body 205 further includes a plurality of recesses 210 circumferentially spaced around the body 205 to receive a plurality of expansion assemblies 250. In one embodiment, three recesses 210 are spaced at 120 degree increments about a circumference of the body 205. It should be noted, however, that any number of recesses 210 and expansion assemblies 250 may be employed without departing from the principles of the present invention. The bore 215 can be any pathway through the expander tool 200 that permits fluid flow through the expander tool 200 and/or provides fluid to the expansion assemblies 250. Thus, the bore 215 may not be required at all depending on the application and the type of expansion assembly 250 used in the expander tool 200. As shown, the expander tool 200 can include a sleeve 232 formed by two halves secured to the outside of the body 205 adjacent the recesses 210. Bolts positioned in apertures 230 secure the sleeve 232 to the body 205. Apertures 234 defined by the sleeve 232 permit a first portion of the expansion assemblies 250 to extend from the expander tool 200 while preventing a second portion of the expansion assemblies 250 from moving beyond the recess 210.

Each expansion assembly 250 includes a piston 240 that is radially extendable. The piston 240 is preferably an elongated body which is sealingly disposed within the appropriately configured recess 210 of the expander tool 200. The piston 240 includes a top surface and a bottom surface. The top surface receives a bearing body as subsequently discussed, and the bottom surface of each piston 240 is exposed to the pressure of fluid within the bore 215 of the expander tool 200. In this manner, pressurized fluid provided from the surface of the well can act upon the pistons 240 and cause them to extend radially outward.

Figure 4:
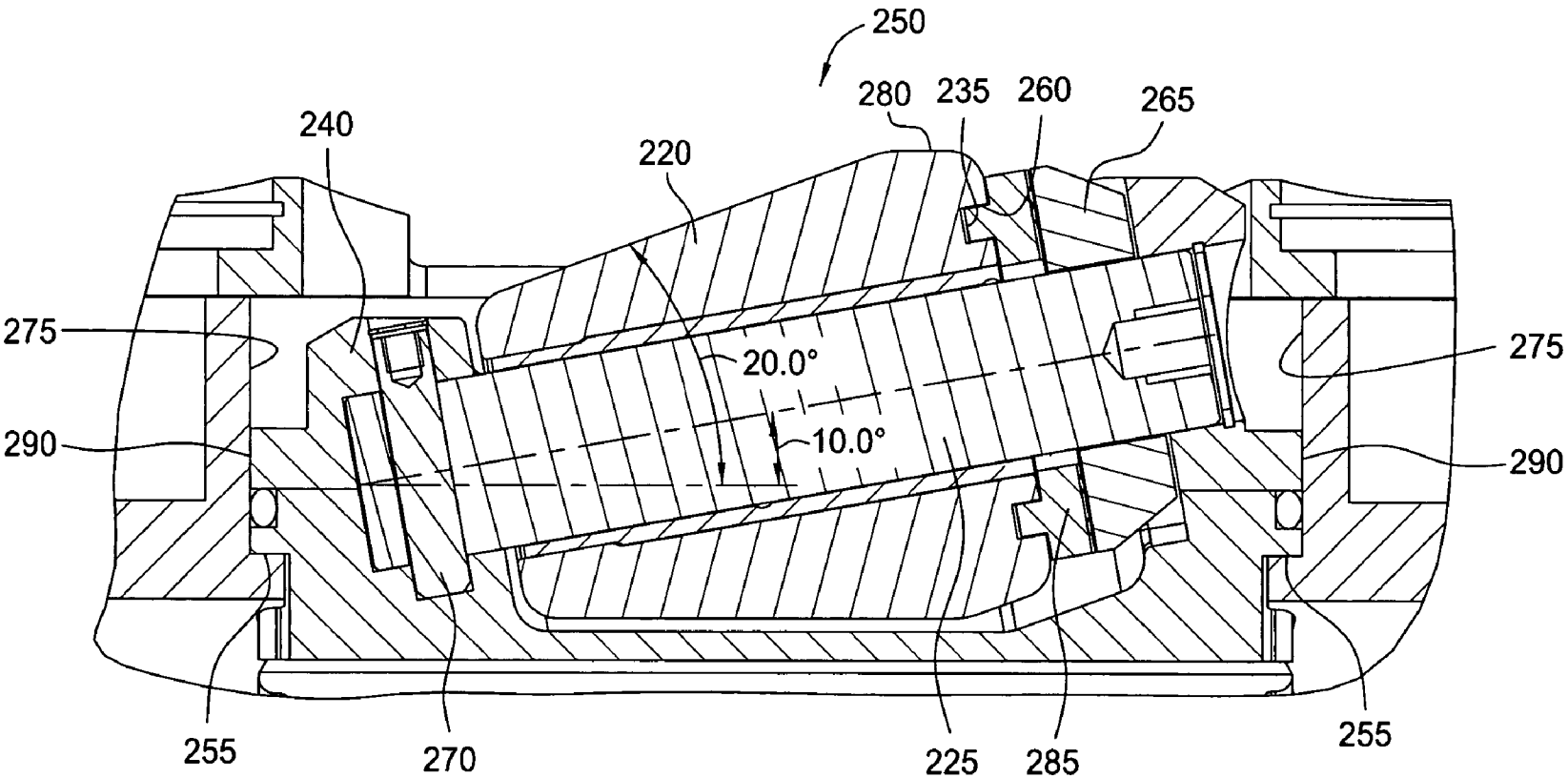
FIG. 4 is an enlarged section view of an expansion assembly of FIG. 3.

FIG. 4 illustrates an enlarged section view of the expansion assembly 250. As shown, each expansion assembly 250 further includes a roller 220. In one embodiment, the outer surface of the rollers 220 are arranged at a slope outward from the center of the tool 200, such as 20.0 degrees, relative to the longitudinal axis of the expander tool 200. The slope improves the contact between the roller 220 and the surrounding tubular during expansion of the surrounding tubular. In order to at least partially obtain the slope, the roller has a tapered thickness such that the thickness increases toward a nose portion 280 at the upper end of the roller 220. The thicker nose portion 280 extends the life of the roller 220 by providing more material to wear away.

A shaft 225 supports each roller 220 for rotation about a respective axis. In one embodiment, the rollers 220 and their respective shafts 225 are angled, such as 10.0 degrees, relative to the longitudinal axis of the expander tool 200. The shaft 225 positioned at the angle further provides the slope of the outer surface of the rollers 220 and improves a rolling ratio between the expander tool 200 and a surrounding tubular being expanded. The rolling ratio is calculated on the basis of an outer circumference of the rollers 220 and an inner circumference of the tubular at points along a theoretical contact length of the roller 220. In other words, the thicker nose portion 280 adjacent an enlarged circumference of the tubular travels further about the roller's axis than the opposite end of the roller 220 adjacent a non-enlarged circumference of the tubular. However, the roller 220 rotates at a single speed thereby restricting the entire length of the outer circumference of the roller to one speed and causing friction and sliding at the contact between the roller 220 and the tubular. As the rolling ratio improves or approaches one, the outer surface speed across the entire length of the roller 220 approaches the speed at which the outer surface moves across the inner circumference of the tubular, thereby reducing the tangential force at the contact. The reduction of the tangential force results in a reduction of torque and subsequently the reduction of torsional deformation of the tubular. Additionally, the angle of the shaft 225 permits the expansion assembly 250 to radially extend the roller 220 further outward than known expander tools, thereby allowing the expander tool 200 to expand a tubular to a larger diameter, such as a casing having an inner diameter of 6.538".

The top surface of the piston 240 receives a first bearing member 265 and a second bearing member 285 at a first end and a rear bearing member 270 at a second end. In one embodiment, the first bearing member 265 and the rear bearing member 270 are TOUGHMET® bearings. The roller 220 includes a roller profile 235 formed at an upper end thereof. The roller profile 235 mates with a bearing profile 260 to form a bearing connection between the second bearing member 285 and the roller 220 that prevents relative rotation between the second bearing member 285 and the roller 220. In one embodiment, the roller profile 235 and the mating bearing profile 260 are crescent shaped with a rounded profile to prevent stress risers in the connection. Frictional wear is limited to the rotational contact between the first bearing member 265 and the second bearing member 285. By eliminating the relative rotation between the roller 220 and the second bearing member 285, heating and wearing of the roller 220 reduces. While not shown, the rear bearing body 270 can lock to a lower end of the roller 220 by any known slot arrangement.

An outer diameter portion 255 of the piston 240 includes at least a portion disposed at either end thereof having an outer surface 290 for substantially contacting an inner surface 275 of the recess 210 shown in FIG. 3. Forces that can cause longitudinal tilting of the piston 240 relative to the body 205 are transposed across a width of the surface 290. The outer surface 290 that contacts the inner surface 275 is sufficiently wide to prevent the piston 240 of the expansion assembly 250 from tilting back when the expander tool 200 expands the surrounding tubular.

Figures 5, 6:
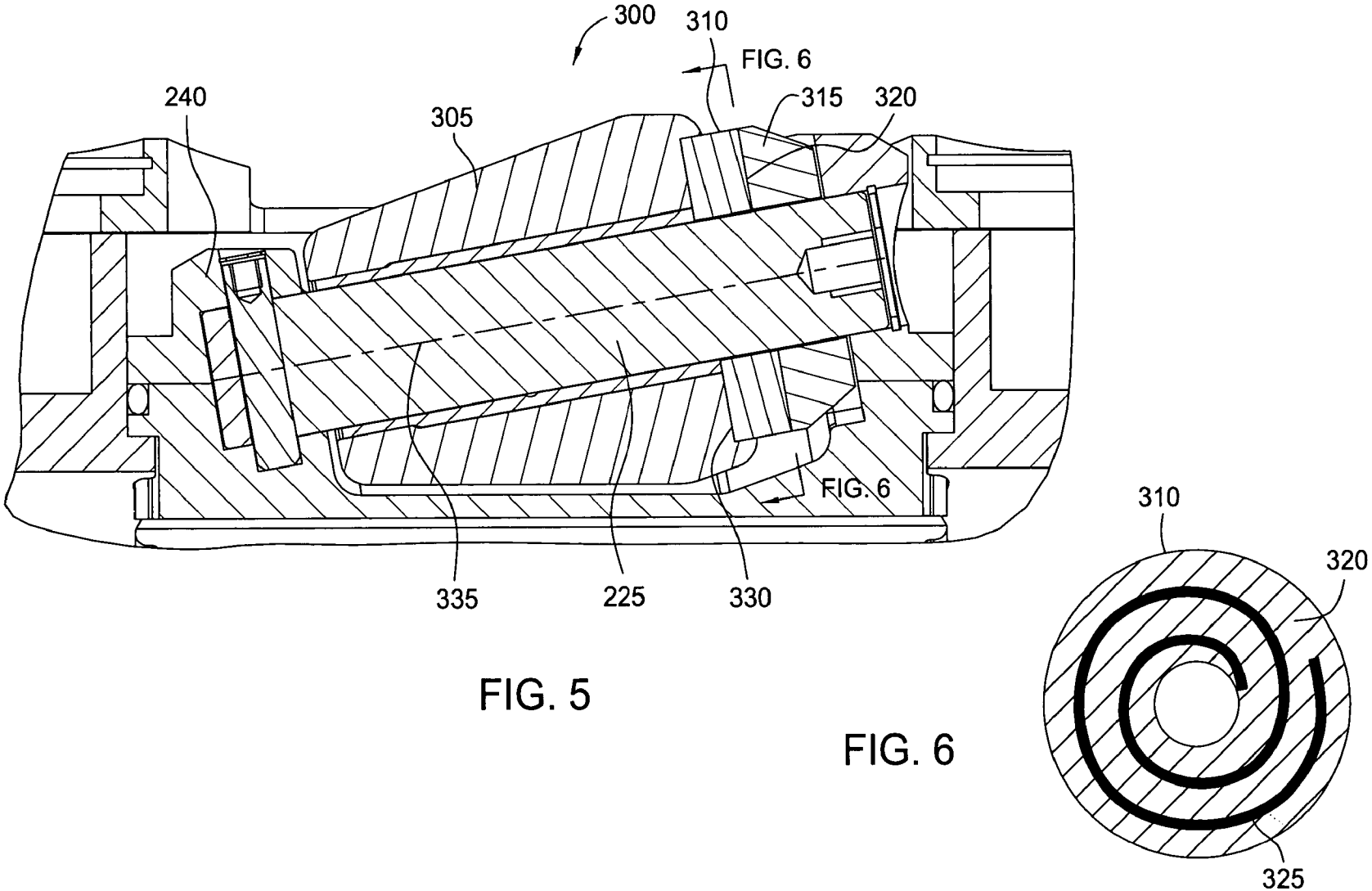
FIG. 5 is an alternative embodiment of an expansion assembly shown in section for use with the expander tool.
FIG. 6 is a section view illustrating a first bearing body with a fluid path formed therein.

FIG. 5 shows a section view of an alternative embodiment of an expansion assembly 300 for use with the expander tool 200. For convenience, the components of the expansion assembly 300 that are similar to the components in the expansion assembly 250 are labeled with the same reference number. In this embodiment, the expansion assembly 300 includes a first bearing body 310 placed between a roller 305 and a stationary second bearing body 315. A shaft 225 supports the roller 305 for rotation about a respective axis 335. An upper end of the roller 305 couples to the first bearing body 310 by any attachment means well known in the art to allow the first bearing body 310 to rotate with the roller 305 about the respective axis 335. For instance, the upper end of the roller 305 may be keyed to a roller surface 330 on the first bearing body 310.

The first bearing body 310 includes a bearing surface 320 that is in substantial contact with the second bearing body 315. The second bearing body 315 is operatively attached to the piston 240 by a means known in the art. In this manner, the second bearing body 315 remains rotationally stationary while the roller 305 and the first bearing body 310 rotate about the respective axis 335. Therefore, the arrangement of the first bearing body 310 and the second bearing body 315 eliminates the relative rotation between the roller 305 and a specific bearing body. Eliminating the relative rotation between the roller 305 and a specific bearing body limits the frictional wear to the contact between the first bearing body 310 and the second bearing body 315. The first bearing body 310 and the second bearing body 315 are preferably made from the same hard material in order to reduce the wear of the first bearing body 310 and the second bearing body 315.

FIG. 6 illustrates a section view of the first bearing body 310 having an optional fluid path 325 formed therein. Preferably, the fluid path 325 is formed on the bearing surface 320. The fluid path 325 is constructed and arranged to promote the ingress of fluid, thereby providing a fluid cushion between the first bearing body 310 and the second bearing body 315. The fluid cushion reduces the friction between the bearing bodies 310, 315 and removes a portion of heat generated by the bearing bodies 310, 315 during operation of the expander tool 200. In the embodiment shown, the fluid path 325 is configured as a helical groove; however, it is to be understood that the fluid path 325 may be formed from any configuration well known in the art.

Figure 7:
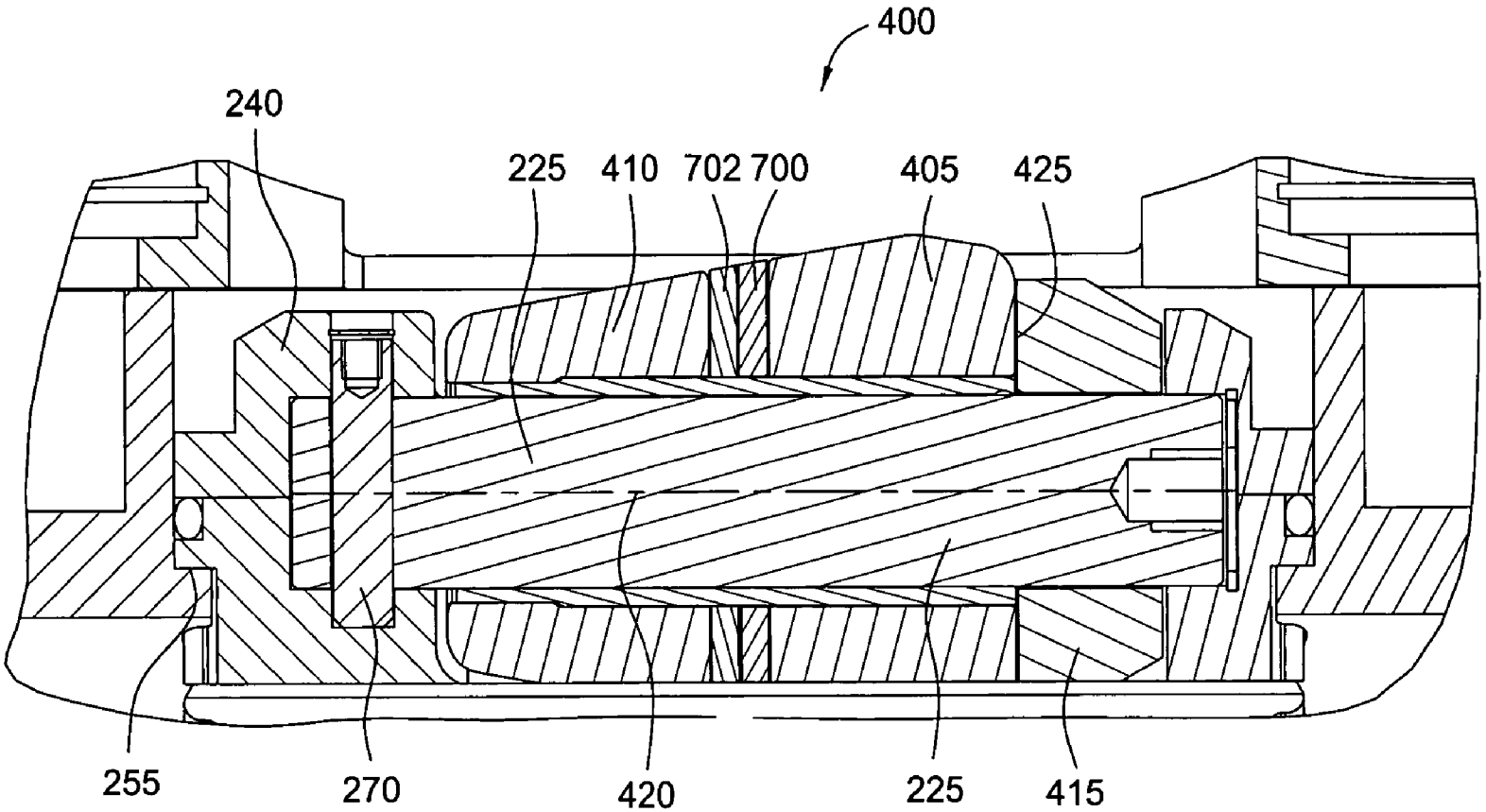
FIG. 7 is a section view of an alternative embodiment of an expansion assembly for use with the expander tool.

FIG. 7 shows a section view of an alternative embodiment of an expansion assembly 400 for use with the expander tool 200. For convenience, the components in the expansion assembly 400 that are similar to the components in the expansion assembly 250 are labeled with the same reference number. The expansion assembly 400 includes a first roller 405 disposed adjacent a bearing body 415, a second roller 410, a first roller bearing 700 coupled to the first roller 405, and a second roller bearing 702 coupled to the second roller 410. It should be understood, however, that the expansion assembly 400 may include any number of rollers without departing from the principles of the present invention. As illustrated, a shaft 225 supports both rollers 405, 410 for rotation about a respective axis 420. Since the first roller 405 has a larger outer diameter than the second roller 410, the first roller 405 rotates at a different rate than the second roller 410. Thus, by separating the first roller 405 from the second roller 410, the slippage between the expansion assembly 400 and the surrounding tubular being expanded reduces. In other words, the rollers 405, 410 contact the surrounding tubular at the same time; however, the amount of slippage therebetween reduces and results in a decrease in a residual torsional effect on the surrounding tubular since the rollers 405, 410 can rotate at a different rate.

The first roller bearing 700 couples to the first roller 405 by any known means such as a castellation or a key that prevents relative rotation between the first roller bearing 700 and the first roller 405. Similarly, the second roller bearing 702 couples to the second roller 410 to prevent relative rotation between the second roller bearing 702 and the second roller 410. Thus, frictional rotation occurs between the first roller bearing 700 and the second roller bearing 702 and not between the rollers 405, 410. This reduces heat and wear of the rollers 405, 410. While the expansion assembly 400 is shown having the first roller bearing 700 and the second roller bearing 702, the expansion assembly can include a single bearing between the rollers 405, 410 that is either not coupled to the rollers 405, 410 or only coupled to one of the rollers 405, 410. Additionally, the expansion assembly 400 may lack a bearing between the rollers 405, 410 such that rotational friction due to the differential speed of the rollers 405, 410 occurs between the rollers 405, 410.

The bearing body 415 can be replaced with any of the other bearing arrangements described herein.

Figure 8:
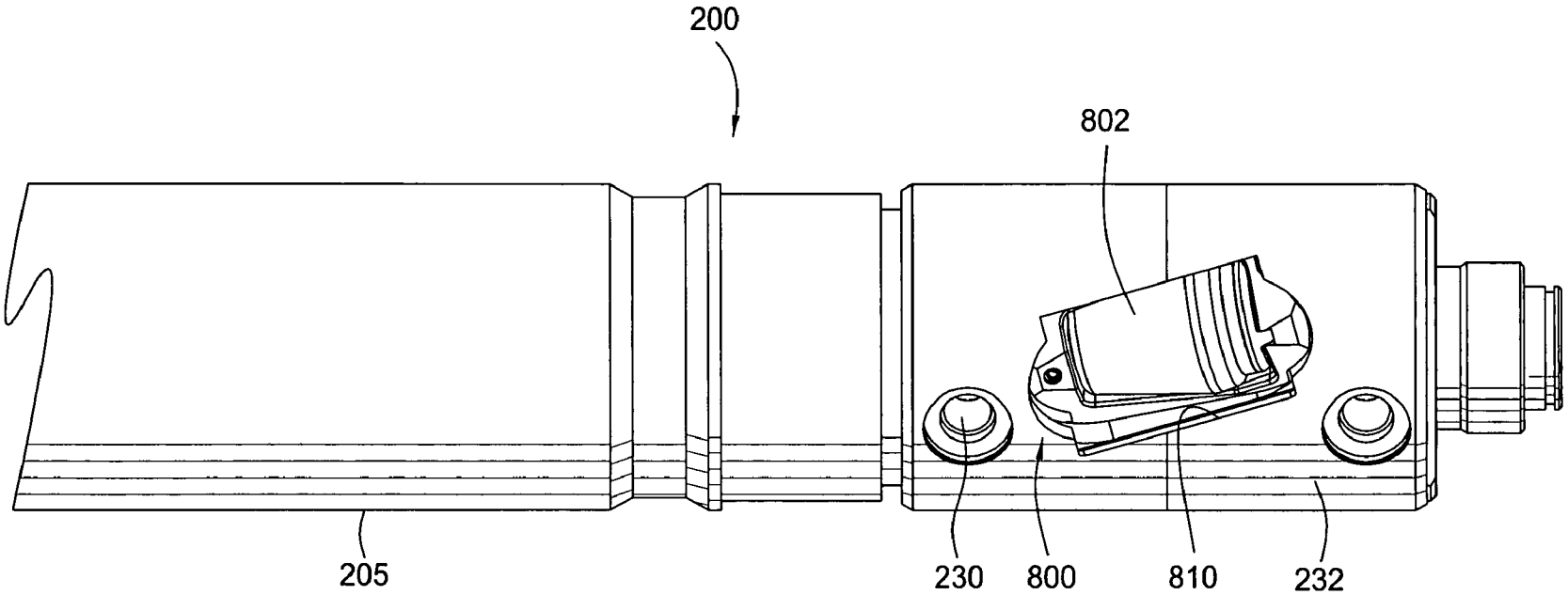
FIG. 8 is a longitudinal view of an expander tool having an expansion assembly skewed relative to a longitudinal axis of the expander tool.

FIG. 8 illustrates an embodiment of the expander tool 200 with expansion assemblies 800 disposed along the tool 200 at a skew relative to a longitudinal axis of the tool 200. Thus, a recess 810 that receives the expansion assemblies 800 is skewed relative to the longitudinal axis of the tool 200. Due to the skew, a roller 802 of each expansion assembly contacts a surrounding tubular at an angle during expansion of the surrounding tubular. Based on the skew angle of the expansion assemblies 800 and the direction of rotation of the tool 200, the roller 802 provides a tractoring effect along an axial length of the surrounding tubular. The tractoring effect further reduces slippage and friction between the roller 802 and the surrounding tubular since rotation of the roller 802 at least partially moves the tool 200 axially through the surrounding tubular without requiring a pulling or pushing force perpendicular to the axis of rotation of the roller 802.

Figure 9:
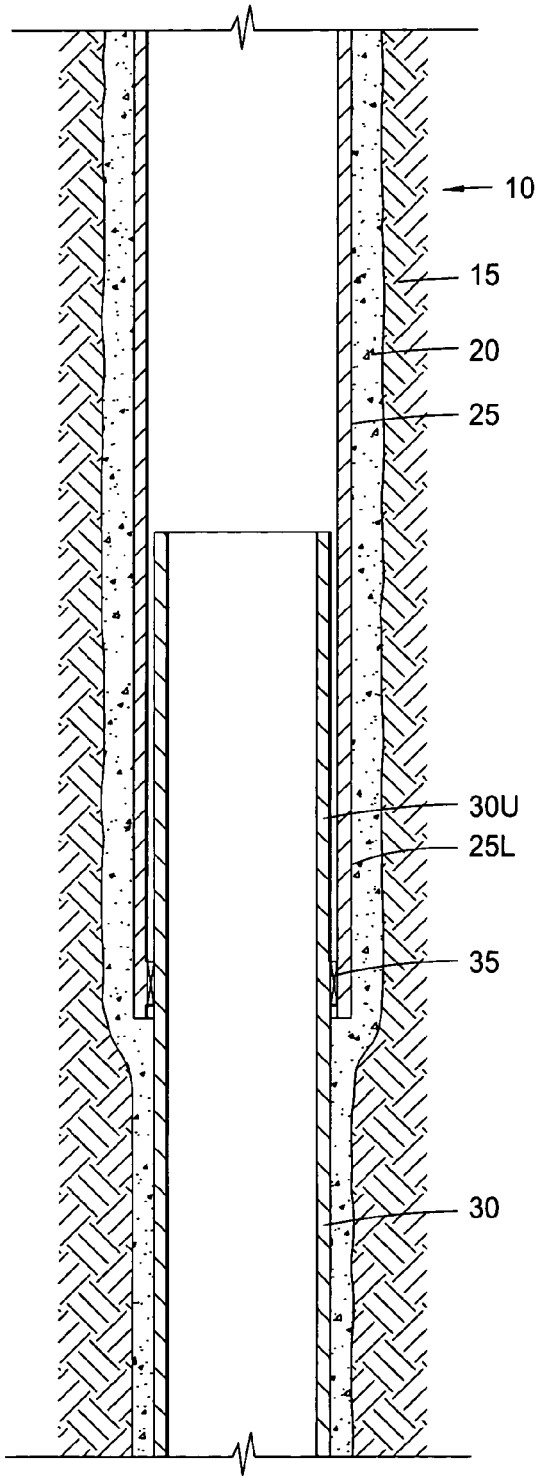
FIG. 9 is a cross-sectional view of a wellbore having an upper string of casing and a lower string of casing which serves as a tubular body to be expanded.
Figure 10:
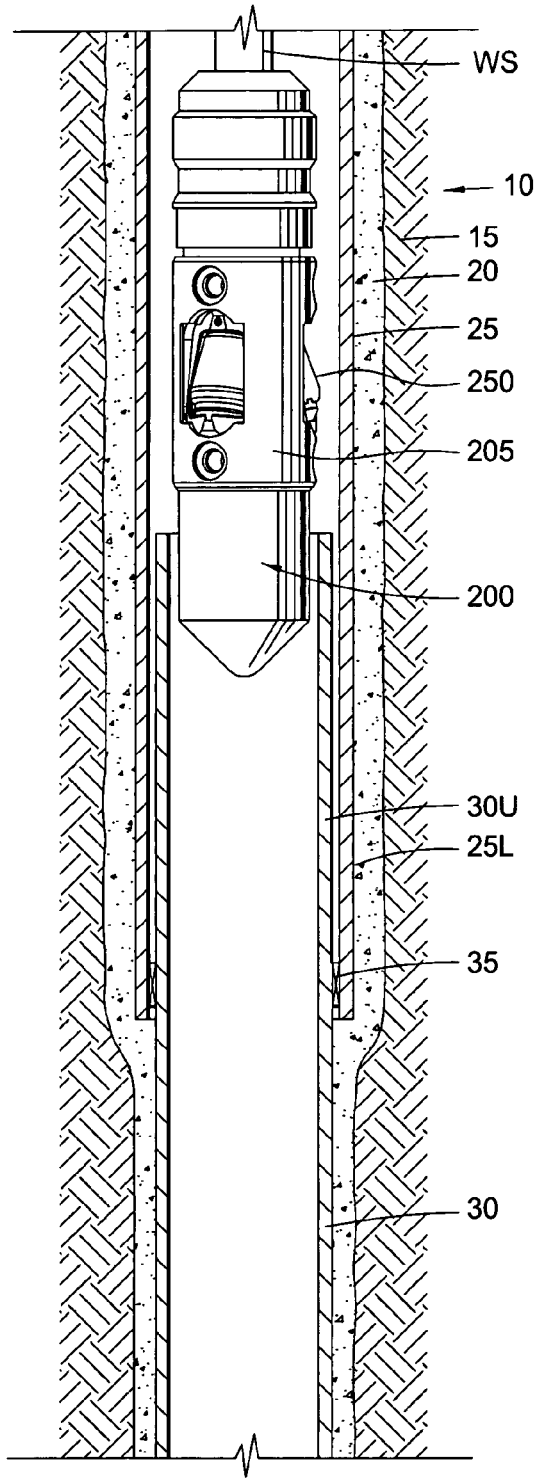
FIG. 10 is a cross-sectional view of the wellbore of FIG. 9 further illustrating an expander tool of the present invention lowered into the wellbore on a working string.
Figure 11:
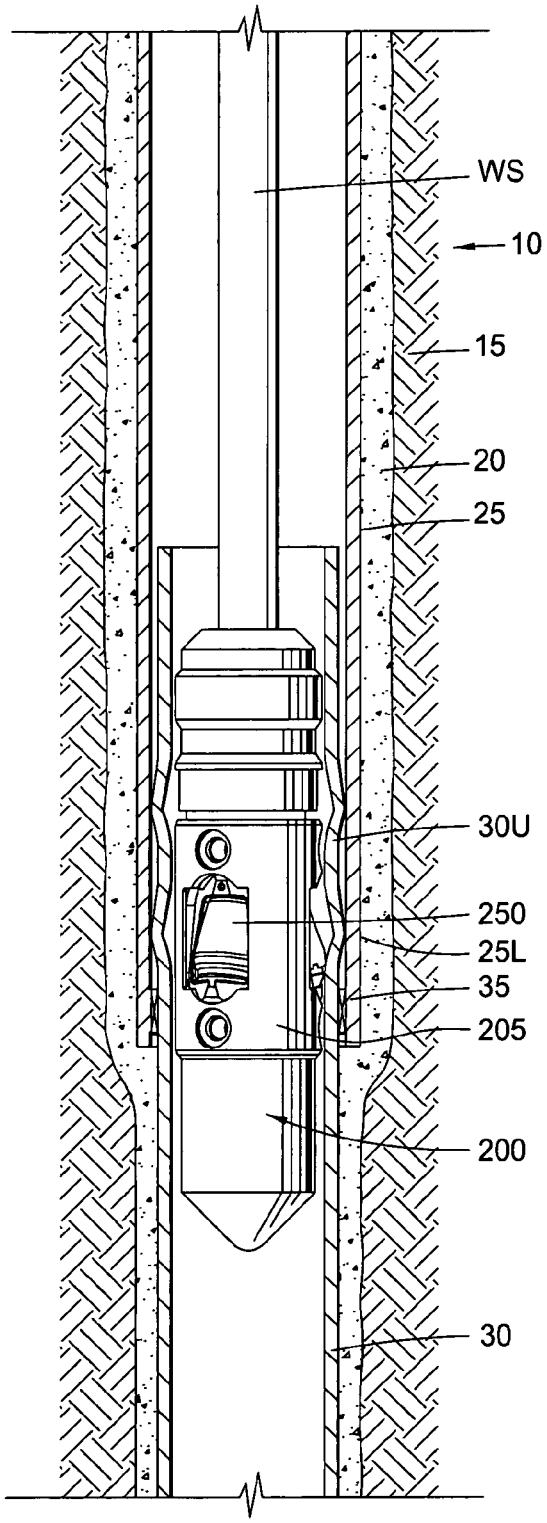
FIG. 11 is a cross-sectional view of the wellbore in FIG. 9 further illustrating the expander tool having partially expanded the lower string of casing into the upper string of casing.

FIGS. 9-11 demonstrate the operation of an expander tool of the present invention. FIG. 9 provides a cross-sectional view of a wellbore 10 cased with an upper string of casing 25. The upper string of casing 25 is cemented into a surrounding formation 15 by a slurry of cement 20. The wellbore 10 also includes a lower string of casing 30, sometimes referred to as a "liner." The lower string of casing 30 includes an upper portion 30U positioned in the wellbore 10 at such a depth as to overlap with a lower portion 25L of the upper string of casing 25. It can be seen that the lower string of casing 30 is also cemented into the wellbore 10. As schematically shown in FIG. 9, a packer 35 provides support for the lower string of casing 30 within the upper string of casing 25 before the cement 20 behind the lower sting of casing 25 cures.

As shown in FIG. 10, a working string WS having an expander tool 200 affixed at the bottom lowers into the wellbore 10. The expander tool 200 includes improved expansion assemblies 250. It should be noted, however, that other expansion assemblies such as any combination of those previously described herein may be employed with the expander tool 200.

Referring to FIG. 11, the expander tool 200 lowers to a depth within the wellbore 10 adjacent the overlapping strings of casing 25L, 30U. The expansion assemblies 250 of the expander tool 200 actuate. In this manner, the upper portion 30U of the lower string of casing 30 expands into frictional engagement with the surrounding lower portion 25L of the upper string of casing 25. As shown, the lower string of casing 30 is expanded at two locations. However, the expander tool 200 can expand the lower string of casing 30 at any number of locations or along one axial length of the lower string of casing 30.

In order to actuate the expander tool 200, fluid injects into the working string WS. The pressurized fluid travels downhole through the working string WS into the tool 200. From there, fluid contacts the bottom surfaces of the pistons. As hydraulic pressure increases, fluid forces the pistons radially outward from their respective recesses. This, in turn, causes the rollers 220 to make contact with the inner surface of the casing 30. With a predetermined amount of fluid pressure acting on the bottom surface of the piston, the lower string of expandable casing 30 expands past its elastic limits. Fluid can exit the expander tool 200 through the bottom of the tool 200 and/or through ports (not shown) that are located on the side of the tool 200. Alternatively, the tool 200 may be closed such that fluid does not exit the tool at all.

It will be understood by those of ordinary skill in the art that the working string WS shown in FIGS. 10 and 11 is highly schematic. It is understood that numerous other tools may and commonly are employed in connection with a well completion operation. For example, the lower string of casing 30 typically runs into the wellbore 10 on the working string WS itself. Other tools such as a cement shoe (not shown) and a wiper plug (also not shown) are often included on the working string WS and the casing 30. Numerous other tools to aid in the cementing and expansion operation may also be employed, such as a swivel (not shown) and a collet or dog assembly (not shown) for connecting the working string WS with the casing 30.

Figure 12:
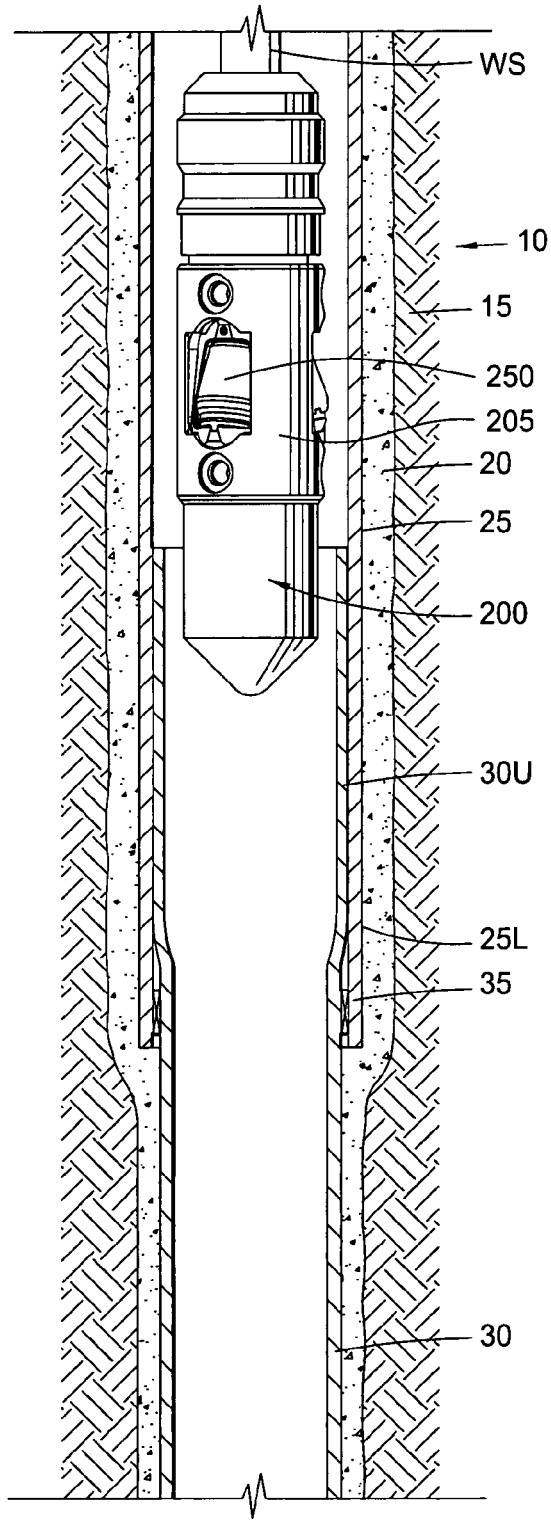
FIG. 12 is a cross-sectional view of the wellbore in FIG. 9 illustrating the expander tool being removed from the wellbore after the lower string of casing has been expanded into the upper string of casing along a desired length.

FIG. 12 presents the lower string of casing 30 expanded into frictional engagement with the surrounding upper string of casing 25 along a desired length. In this view, the upper portion 30U of the lower string of casing 30 has utility as a polished bore receptacle. Alternatively, a separate polished bore receptacle can be landed into the upper portion 30U of the lower string of casing 30 with greater sealing capability. Further, a larger diameter of tubing (not shown) may be landed into the casing 30 due to the expanded upper portion 30U of the casing 30. It is understood that the depictions in FIGS. 9, 10, and 11 are simply to demonstrate one of numerous uses for an expander tool 200 and to demonstrate the operation of the expansion assembly 250.

As demonstrated, an improved expansion assembly 250 for an expander tool 200 has been provided. In this respect, the rollers 220 of the expansion assembly 250 are able to reside in close proximity to the surface of the piston.

The above description is provided in the context of a hydraulic expander tool. However, it is understood that the present invention includes expander tools in which the pistons are moveable in response to other radially outward forces, such as mechanical forces. Applications for use of the expander tool other than in a wellbore as illustrated herein merely by way of example are envisioned. While the foregoing is directed to embodiments of the present invention, other and further embodiments of the invention may be devised without departing from the basic scope thereof, and the scope thereof is determined by the claims that follow.

The invention claimed is:

1. An expander tool for use in a wellbore, the expander tool comprising:

a body having at least one recess formed therein; and a piston assembly disposable in the at least one recess, the piston assembly radially extendable from the body in response to a fluid force, the piston assembly comprising:

a piston housing;

a shaft disposed in the piston housing;

a roller rotationally disposed on the shaft;

a bearing assembly disposed on the shaft adjacent an end of the roller, the bearing assembly including a portion that rotates with the roller and a portion that remains stationary, wherein the bearing assembly is configured to substantially eliminate frictional wear between the roller and the piston housing; and a sleeve member disposed between the roller and the shaft.

2. The expander tool of claim 1, wherein the bearing assembly includes a bearing profile matable with a corresponding profile formed in the roller.

3. The expander tool of claim 1, further including a cooling channel disposed between the portions of the bearing assembly.

4. The expander tool of claim 3, wherein the cooling channel is a helical groove formed in the bearing member.

5. The expander tool of claim 4, wherein the cooling channel is a fluid path constructed and arranged to promote the ingress of a fluid therein.

6. The expander tool of claim 1, wherein an outer diameter portion of the piston housing includes at least a portion disposed at either end thereof having an outer surface for substantially contacting an inner surface of the recess, the portions having substantial width to prevent tipping of the piston housing in the recess.

7. The expander tool of claim 1, wherein the sleeve member is configured to allow the roller to rotate relative to the shaft.

8. An expander tool for use in a wellbore, the expander tool comprising:

a body having at least one recess formed therein; and a piston assembly disposable in the at least one recess, the piston assembly radially extendable from the body in response to a fluid force, the piston assembly comprising:

a piston housing;

a shaft disposed in the piston housing;

a roller rotationally disposed on the shaft;

a first bearing member having at least one projection configured to mate with at least one depression formed in the roller;

a second bearing member disposed adjacent the first bearing member, wherein the second bearing member remains stationary relative to the first bearing member.

9. The expander tool of claim 8, wherein the second bearing member fixed to the piston housing.

10. The expander tool of claim 8, further including a second bearing assembly disposed on the shaft adjacent another end of the roller.

11. The expander tool of claim 10, wherein the second bearing body is locked to the roller assembly by a slot arrangement.

12. The expander tool of claim 8, wherein the first bearing member is matable with the roller, thereby rotating with the roller.

13. The expander tool of claim 8, wherein the second bearing member is matable with the piston, thereby remaining rotationally stationary relative to the body.

14. The expander tool of claim 8, further including a cooling channel between the bearing members.

15. The expander tool of claim 8, wherein an outer diameter portion of the piston housing includes at least a portion disposed at either end thereof having an outer surface for substantially contacting an inner surface of the recess, the portions having substantial width to prevent tipping of the piston housing in the recess.

16. The expander tool of claim 8, wherein the roller comprises a first roller and a second roller.

17. The expander tool of claim 8, wherein the roller and the shaft are constructed and arranged on the piston at an angle relative to a longitudinal axis of the expander tool.

18. An expander tool for use in expanding a tubular in a wellbore, the expander tool comprising:

a body having at least one recess formed therein, the recess having a sliding surface; and an expansion assembly disposable in the at least one recess and movable relative to the body, the expansion assembly having a housing, wherein an outer diameter portion of the housing includes at least a portion disposed at either end thereof having an outer surface for substantially contacting an inner surface of the recess, the portions having substantial width to prevent tipping of the piston in the recess;

the expansion assembly comprises:

a shaft disposed in the housing;

a roller rotationally disposed on the shaft;

a first bearing member fixed to the roller;

a second bearing member disposed adjacent the first bearing member, wherein the second bearing member remains stationary relative to the first bearing member.

19. A method for expanding a tubular body within a wellbore, comprising:

disposing an expander tool in a wellbore proximate the tubular body, the expander tool having an expansion assembly comprising, a piston housing, a roller and shaft arrangement, a first bearing member and a second bearing member disposed adjacent the first bearing member;

extending the expansion assembly radially outward from the expander tool and into contact with the tubular body due to a fluid force;

rotating the roller and first bearing member on the shaft relative to the second bearing member and the piston housing as the tubular member is expanded; and substantially preventing the expansion assembly from tilting back relative to the expander tool during expansion of the tubular body.

20. An expander tool for use in a wellbore, the expander tool comprising:

a body having at least one recess formed therein; and a piston assembly disposable in the at least one recess, the piston assembly radially extendable from the body in response to a fluid force, the piston assembly comprising:

a piston housing;

a shaft disposed in the piston housing;

a roller assembly rotationally disposed on the shaft; and a bearing assembly disposed on the shaft adjacent an end of the roller, the bearing assembly includes a portion that rotates with the roller and a portion that remains stationary, wherein the bearing assembly is configured to substantially eliminate frictional wear between the roller and the piston housing.

a second bearing assembly disposed on the shaft adjacent another end of the roller, wherein the second bearing assembly is locked to the roller assembly by a slot arrangement.

21. The expander tool of claim 20, wherein an outer diameter portion of the piston housing includes at least a portion disposed at either end thereof having an outer surface for substantially contacting an inner surface of the recess, the portions having substantial width to prevent tipping of the piston housing in the recess.

* * * * *